United States Patent [19]

Virving

[11] Patent Number: 4,953,796

[45] Date of Patent: Sep. 4, 1990

[54] REFINER SEGMENT

[75] Inventor: Nils Virving, Vällingby, Sweden

[73] Assignee: Sunds Defibrator Aktiebolag, Sweden

[21] Appl. No.: 378,224

[22] PCT Filed: Feb. 23, 1988

[86] PCT No.: PCT/SE88/00076

§ 371 Date: Jun. 27, 1989

§ 102(e) Date: Jun. 27, 1989

[87] PCT Pub. No.: WO88/06490

PCT Pub. Date: Sep. 7, 1988

[30] Foreign Application Priority Data

Feb. 25, 1987 [SE] Sweden ..... 8700790

[51] Int. Cl.[5] ..... B02C 7/12

[52] U.S. Cl. ..... 241/298

[58] Field of Search ..... 241/261.2, 261.3, 296, 241/298, 297, 244

[56] References Cited

U.S. PATENT DOCUMENTS

| | | | |
|---|---|---|---|
| 3,040,997 | 6/1962 | Borden | 241/261.3 |
| 4,676,440 | 6/1987 | Perkola | 241/296 X |

FOREIGN PATENT DOCUMENTS

| | | |
|---|---|---|
| 73256 | 5/1987 | Finland . |
| 1189470 | 10/1959 | France . |
| 437226 | 6/1983 | Sweden . |

*Primary Examiner*—Mark Rosenbaum

*Attorney, Agent, or Firm*—Lerner, David, Littenberg, Krumholz & Mentlik

[57] ABSTRACT

A refiner segment (1) for disc refiners is formed with a pattern of bars (2,4) and grooves (3,5), and flow restrictions (6) are located in the grooves (5). Through apertures (8) in the bars (4), the grooves (5) communicate with each other so that the grooves have free communication outward and inward via the apertures (8).

7 Claims, 1 Drawing Sheet

REFINER SEGMENT

This invention relates to refiner segments in a disc refiner for refining fiber material, which can be wood chips or pulp, which is entirely or partially defibered.

The disc refiner comprises two opposed refiner discs, one or both of which can be rotatable. On the refiner discs refiner segments are located, which are formed with a pattern of bars and intermediate grooves. The refiner discs are positioned so that the refiner segments form a disc gap, through which the fiber material is intended to pass, whereby the refining is carried out by the bars of the refiner segments.

The bars and grooves of the refiner segments normally extend substantially radially. The pattern can be divided into different zones located outside each other.

During the refining of fiber material with high concentration, and especially at high energy charges, it was found necessary to insert flow restrictions, so-called cross-bars, in the grooves in the refiner segments in order to prevent unprocessed material from passing out through the disc gap. These cross bars, however, constitute a hindrance for the steam, which during the refining develops in the disc gap. Consequently a high steam pressure arises in the disc gap. This high steam pressure has a negative effect on the capacity and operating stability of the refiner, and it also limits the possible energy charge. The steam developed, thus, is forced upward out of the grooves by the flow restrictions and disturbs the material flow through the disc gap.

One way of solving the aforesaid problem is to supply dilution water to the disc gap in order to condense the steam. This way, however, causes a reduction in the material concentration to such a low level that the pulp quality deteriorates.

The present invention provides a solution to the problem of high steam pressure in the disc gap, without giving rise to other inconveniences during refining. According to the invention, the bars on the refiner segment are formed with apertures which interconnect adjacent grooves, so that the grooves communicate freely outward and inward via the apertures. This implies that the steam developed is not obstructed by the cross bars, but can flow through the apertures to the adjacent groove and further outward or inward. The steam pressure resulting in the disc gap increases in the outward direction to a maximum and thereafter decreases toward the outlet of the disc gap. This implies that steam formed in the interior part of the disc gap, i.e. inside of said pressure maximum, flows inward, while steam forming in the outer part of the disc gap flows outward to the outlet of the disc gap.

Figure 1:
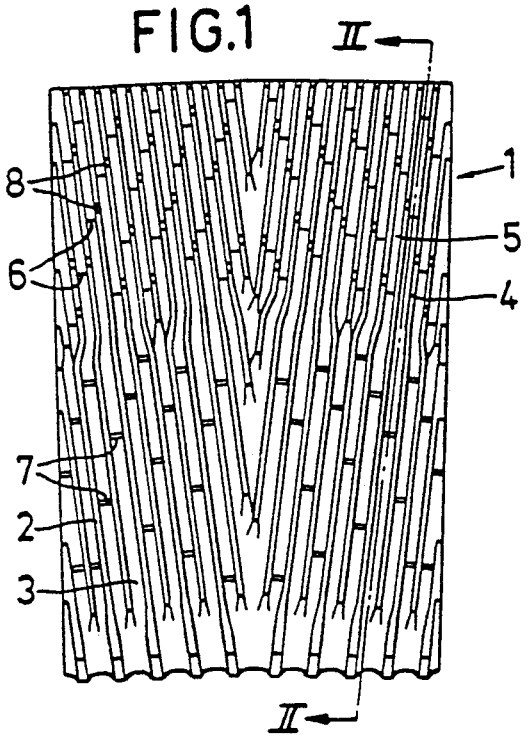
Figure 2:
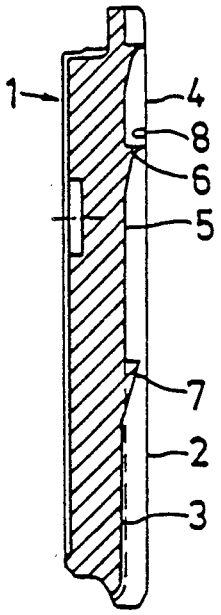
Figure 3:
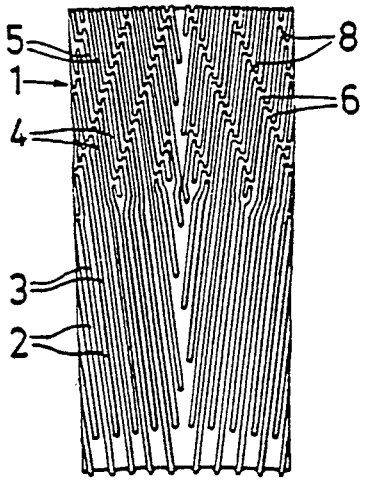

The invention is described in greater detail in the following, with reference to the accompanying drawing showing two embodiments of a refiner segment according to the invention, in which drawing FIG. 1 shows a refiner segment seen perpendicularly to the surface, FIG. 2 is a section along II—II in FIG. 1, and FIG. 3 shows another embodiment of a refiner segment.

Refiner segments 1 according to the Figures are formed with a pattern of substantially radial bars and intermediate grooves. The pattern is divided into two zones, an inner one and an outer one. The bars 2 and grooves 3 in the inner zone are coarser than the bars 4 and grooves 5 in the outer zone. In the outer zone flow restrictions 6 are located. In the embodiment according to FIGS. 1 and 2 flow restrictions 7 are also provides in the inner zone, but such restrictions are not provided in the embodiment shown in FIG. 3. The flow restrictions 7 in the inner zone do not extend all the way to the upper surface of the bars 2, while the flow restrictions 6 in the outer zone extend up to the level of the upper surface of the bars 4. In the outer zone the grooves 5 communicate with each other through apertures 8 in intermediate bars 4. Each of these apertures 8 is located in close connection to a flow restriction 6 and in a radial direction outside the same. The apertures 8 preferably are U-shaped and extend a distance downward from the upper surface of the bars 4.

The apertures 8 are located so that there is free communication both outward and inward via the apertures 8 and grooves 5. The steam development during the refining is especially high in the outer zone where the steam pressure maximum is located. The apertures 8, therefore, provide a possible passage for the steam over to adjacent grooves 5, in which the steam can continue to flow outward or inward and possibly via additional apertures 8 and grooves 5 finally leave the disc gap at the outlet or inlet thereof.

In the embodiment according to FIG. 3 the apertures 8 and flow restrictions 6 are located so that each aperture is located, counted in a radial direction, immediately outside a flow restriction in a groove and immediately inside a flow restriction in adjacent grooves. The return flow of the steam through grooves is thereby minimized, because it is obstructed by the flow restrictions.

In cases when the refiner segment is formed with more zones, the apertures in the first hand should be placed in the outermost zone where they will be most useful due to the great steam formation in said zone.

The invention, of course, is not restricted to the embodiments shown, but can be varied within the scope of the invention idea.

I claim:

1. An improved disc refiner for refining fibrous materials, said disc refiner having a refiner segment formed with a pattern including a plurality of radially disposed bars having an upper surface, a plurality of grooves radially disposed intermediate said bars, and a plurality of flow restrictions traversing said grooves between adjacent ones of said bars and extending upward in said grooves to said upper surfaces of said adjacent ones of said bars, at least one of said bars including connecting means for enabling direct communication between a pair of said grooves adjacent said at least one of said bars.

2. A disc refiner as claimed in claim 1 wherein said pattern includes a plurality of zones extending radially from an innermost zone to an outermost zone, and said connecting means on said at least one of said bars is disposed in said outermost zone.

3. A disc refiner as claimed in claim 1 wherein said plurality of said bars includes said connecting means, and wherein each of said connecting means is associated with one of said flow restrictions and is disposed in a location radially outward from said one of said flow restrictions with which it is associated.

4. A disc refiner as claimed in claim 3 wherein said pattern includes a plurality of zones extending radially from an innermost zone to an outermost zone, and said connecting means on said at least one of said bars is disposed in said outermost zone.

5. A disc refiner as claimed in claim 1 wherein said plurality of said bars includes said connecting means, and wherein each said connecting means is disposed in a location radially outward from one of said flow restrictions in a first groove, and radially inward from another of said flow restrictions in a second groove adjacent to said first groove.

6. A disc refiner as claimed in claim 5 wherein said pattern includes a plurality of zones extending radially from an innermost zone to an outermost zone, and said connecting means on said at least one of said bars is disposed in said outermost zone.

7. A disc refiner as claimed in any one of claims 1–6 wherein said connecting means comprise U-shaped channels extending downwardly from said upper surface of said bars.

* * * * *